US007543868B1

(12) United States Patent
Mongan

(10) Patent No.: US 7,543,868 B1
(45) Date of Patent: Jun. 9, 2009

(54) MECHANICALLY ACTUATED VACUUM LIFTING DEVICE

(75) Inventor: Dan Eugene Mongan, Oregon, IL (US)

(73) Assignee: The Caldwell Group, Inc., Rockford, IL (US)

( * ) Notice: Subject to any disclaimer, the term of this patent is extended or adjusted under 35 U.S.C. 154(b) by 428 days.

(21) Appl. No.: 11/403,132

(22) Filed: Apr. 12, 2006

Related U.S. Application Data

(60) Provisional application No. 60/670,775, filed on Apr. 13, 2005.

(51) Int. Cl.
*B66C 1/02* (2006.01)

(52) U.S. Cl. ..... 294/64.1; 294/88

(58) Field of Classification Search ..... 294/64.1, 294/88; 414/627, 737; 901/40; 271/94, 271/96, 103, 107
See application file for complete search history.

(56) References Cited

U.S. PATENT DOCUMENTS

| | | | | | |
|---|---|---|---|---|---|
| 2,274,304 | A | * | 2/1942 | Perry | 92/194 |
| 2,451,593 | A | * | 10/1948 | Washington, Jr. | 294/64.1 |
| 2,681,757 | A | * | 6/1954 | Kellersman | 141/65 |
| 3,347,327 | A | | 10/1967 | Engelen et al. | |
| 3,424,486 | A | * | 1/1969 | Corley | 294/1.2 |
| 3,431,010 | A | | 3/1969 | Glanemann | |
| 3,677,598 | A | | 7/1972 | Becker | |
| 3,702,698 | A | * | 11/1972 | Schwebel | 271/103 |
| 3,704,038 | A | | 11/1972 | Glanemann | |
| 3,785,691 | A | | 1/1974 | Sperry | |
| 3,834,558 | A | * | 9/1974 | Bru | 414/627 |
| 4,635,988 | A | | 1/1987 | Potters et al. | |
| 4,640,503 | A | * | 2/1987 | Naumann | 271/103 |
| 4,925,225 | A | | 5/1990 | Dost | |
| D310,594 | S | | 9/1990 | Johansson | |
| 5,059,088 | A | | 10/1991 | Klein | |
| 5,284,416 | A | * | 2/1994 | Schmidt et al. | 414/627 |
| 5,799,994 | A | * | 9/1998 | Tsai et al. | 294/64.1 |
| 5,879,040 | A | | 3/1999 | Nagai et al. | |
| 5,988,717 | A | | 11/1999 | Foust | |
| 6,039,530 | A | | 3/2000 | Schmalz et al. | |
| 6,345,850 | B1 | | 2/2002 | Foust | |

* cited by examiner

*Primary Examiner*—Dean J Kramer
(74) *Attorney, Agent, or Firm*—Reinhart Boerner Van Deuren P.C.

(57) ABSTRACT

A method and apparatus are provided for vacuum-assisted lifting of a work piece or other object, through use of a lifting apparatus having a cylinder housing adapted at an upper end thereof for supporting a load, a piston rod moveable within the cylinder housing and having a lower exposed end thereof adapted for attachment to a suction cup device, in combination with a non-load bearing piston valve attached to the housing and operatively connected to be moved between an open and a closed position thereof by movement of the piston rod with respect to the housing. The piston valve is attached at an upper end of the housing, and adapted for movement between the open and closed position when contacted by an upper end of the piston rod, on successive strokes of the piston rod. The control valve is removable without disassembly of the remainder of the lifting apparatus.

27 Claims, 12 Drawing Sheets

MECHANICALLY ACTUATED VACUUM LIFTING DEVICE

CROSS-REFERENCE TO RELATED PATENT APPLICATIONS

This patent application claims the benefit of U.S. Provisional Patent Application No. 60/670,775 filed Apr. 13, 2005, the disclosure and teachings of which are incorporated herein by reference.

FIELD OF THE INVENTION

This invention relates generally to an apparatus and method for lifting objects, and more particularly to a method and apparatus for lifting objects with a vacuum lifter.

BACKGROUND OF THE INVENTION

Methods and apparatuses are known in which a load, such as a work piece, or other item to be lifted and moved, are lifted with suction lifters for subsequent transportation during manufacture. After the work piece or lifted object has been moved to a desired position, and lowered onto an appropriate supporting surface, the work piece or object is released from the vacuum lifter for subsequent processing.

Generally such vacuum lifting devices include a cylinder-piston arrangement in which the act of lifting the load generates a vacuum within a fluid cavity defined by the cylinder-piston arrangement. Vacuum developed in the fluid cavity is communicated to a suction cup-type device which grips the load during the lifting operation.

In order to provide for effective and efficient operation of such a lifting device, it is generally desirable that the lifting device be entirely self-contained, with regard to: generating sufficient vacuum at the start of a lifting stroke to allow the lifting device to grip the load; maintaining sufficient vacuum during the lifting stroke; and automatically releasing the vacuum grip on the load at the end of the lifting stroke, when the load has been safely placed on a support, so that the lifting device may be readily lifted away from the load. It is also desirable that at the completion of the lifting stroke, the lifting device be automatically reset, without any intervention from an operator, to a condition whereat the lifting device will be in proper configuration for a successive lifting stroke after being lowered into contact with another load.

In order to provide for automatic sequencing of application and release of vacuum, some prior vacuum lifting devices have included a mechanically actuated control valve, located integrally within the cylinder-piston arrangement, and actuated by relative motion between components of the cylinder-piston arrangement.

In one prior approach to providing such a vacuum lifting device, as disclosed in U.S. Pat. No. 3,347,327 to Engelen, a vertically oriented cylinder circumscribes a piston head suspended from a rod, with the upper end of the rod extending through the cylinder and terminating in a point of attachment to a crane hook or other hoisting apparatus. The lower end of the rod terminates in an enlarged extremity receivable in a depression in the bottom of the cylinder. The depression in the bottom of the cylinder is connected in fluid communication with a suction cup affixed to the bottom end of the cylinder.

The enlarged extremity, at the lower end of the piston rod of Engelen, also functions to block a series of vents extending through the piston head, when the enlarged extremity is bearing against the piston head. When a lifting force is applied to the upper end of the rod of the lifting device of Engelen, the enlarged extremity at the lower end of the rod is pulled into contact with the lower surface of the piston head in a manner blocking the vents through the piston head, such that as continued lifting force is applied, the enlarged extremity on the lower end of the piston rod exerts force against the piston head and pulls the piston head upward within the cylinder. As the piston head moves upward in the cylinder with the vents through the piston head closed, a vacuum is created in the depression in the lower end of the cylinder, which is communicated to the suction cup for gripping and lifting the load. At the end of the lifting stroke, as the load is lowered onto a support, the rod and piston head move downward in the cylinder. When the piston head engages the bottom end of the cylinder, the rod continues to travel downward in a manner allowing the enlarged extremity at the lower end of the rod to move away from the piston head, to thereby open the vents through the piston head and release any remaining vacuum in the depression at the bottom of the cylinder.

The lifting device of Engelen also includes a series of splines on the exterior surface of the rod. The splines, in combination with a ratchet and pawl mechanism mounted at the upper end of the cylinder and including a collar which is rotated 45 degrees on alternate strokes of the rod with respect to the cylinder by the action of the ratchet and pawl mechanism, preclude generation of vacuum within the cylinder on alternate applications of lifting force to the upper end of the rod, so that the lifting device may be lifted free of the load.

The approach taken by Engelen is undesirable for several reasons. First, the arrangement of Engelen requires that the automatic control valve components of Engelen must be load-bearing during both a lifting and a non-lifting application of lifting force to the lifting device. Most notably, when lifting a load, the entire weight of the load and the lifting device of Engelen must be supported by the enlarged extremity at the lower end of the rod through contact of the sealing surface of the enlarged extremity with the lower surface of the piston head. Such an arrangement is highly undesirable, in that the sealing surface is subjected to loads far in excess of what would be required for merely sealing the vents through the piston, thereby leading to reduced reliability and shortened operating life.

On a non-lifting stroke, of the lifting device of Engelen, the upper ends of the splines on the outer surface of the rod must carry the weight of a substantial portion of the lifting device by contacting the lower surface of the rotatable collar of the ratchet and pawl mechanism. Thus, even in a non-lifting mode of operation, the automatic control valve components of Engelen are subjected to high loads, which may cause premature wear and reduced operational life.

In addition, the various components of the automatic control valve of Engelen cannot be removed, for repair or replacement, without total disassembly of the lifting device of Engelen.

Another prior approach to providing a vacuum lifting device, having an automatic control valve, is shown in U.S. Pat. No. 3,431,010, to Glanemann. In Glanemann, an external collar of a control valve housing, extending from the lower end of a piston rod, is pulled into contact with an internal collar of a movable piston, in such a manner that the combined weight, of the lifting device of Glanemann and the load is entirely supported by the interaction of the internal collar of the piston with the external collar of the valve housing portion of the piston rod. A cycling valve arrangement, extending from the lower end of the piston includes a valve disc which opens and closes a hole in the bottom of the piston, on alternate strokes of the piston, for controlling generation and application of vacuum as lifting force is applied at the upper end of the piston rod.

The piston of Glanemann is vertically movable within a cylinder housing, and operatively attached to a crane or other source of lifting force by the valve housing portion of the self-cycling piston valve. A rolling diaphragm is utilized to seal the juncture between the cylinder housing and the piston, in such a manner that when the piston is raised by the valve housing of the self-cycling piston valve, while the piston valve is in a closed position, a vacuum is generated inside the cylinder housing in a space below the piston. The vacuum generated in the space below the piston is communicated to one or more suction pads via vacuum hoses or conduits.

Although the lifting device of Glanemann improves somewhat upon the lifting device of Engelen, by not requiring the valve disc of the control valve of Glanemann to be load bearing, as was the case for the enlarged extremity at the lower end of the rod of Engelen, the valve housing portion of the lower end of the piston rod of Glanemann must still be fully load bearing. In addition, by locating the working components of the valve apparatus of Glanemann within the lower end of the piston rod, the piston rod becomes structurally less efficient than if the control valve components were located elsewhere. Furthermore, as was the case in the lifting device of Engelen, the working components of the control valve of Glanemann are located internally to the lifting device in such a manner that they cannot be removed for repair or replacement without total disassembly of the lifting device of Glanemann.

Also, as was the case with the lifting apparatus of Engelen, because the entire weight of the load and lifting device of Glanemann must be supported through the self-cycling piston valve assembly, rather than directly through structural elements of the lifting device, such as the cylinder housing, the lifting capacity of the lifting device of Glanemann is significantly less than it would be if the weight of the load were carried through other structural components such as the cylinder housing. Also, should a leak occur, as might be experienced due to pinching or puncturing of the rolling diaphragm or suction cup, or the presence of dirt between the suction cup and load, vacuum in the cylinder housing below the piston, in Glanemann, can be significantly and rapidly reduced in a manner that may result in safety concerns if such a loss of vacuum occurs during a load-lifting cycle.

In another prior approach to providing a vacuum lifting device having an automatic control valve, as disclosed in U.S. Pat. No. 3,785,691, to Sperry, a lifting cylinder assembly includes a main cylinder body adapted at an upper end thereof for attachment to a hook means, and a piston plate disposed within the main cylinder body for generating a vacuum within the cylinder body above the piston plate. A piston rod and plunger assembly extends downward from the piston plate and out of the main cylinder body for attachment at a lower end thereof to a suction cup device.

The piston rod and plunger assembly includes a tubular piston rod portion thereof, fixedly attached at an upper end of the tubular piston rod to the piston plate. The plunger rod is inserted into the lower end of the tubular piston rod, and attached to the tubular piston rod by means of a cylindrical pin extending through the plunger rod, with opposite ends of the pin projecting outwardly into opposed slotted openings in the tubular piston rod, to thereby slidingly interconnect the plunger to the cylindrical piston rod in a manner allowing the plunger to move up and down a limited distance within the tubular piston rod.

A first valve means, of Sperry, is located within the tubular piston rod in the hollow space above the upper end of the plunger rod and below the piston plate. The first valve means includes a valve seal which bears against a lower surface of the piston plate to close off a vent opening through the piston plate when it is desired to produce vacuum within the cylinder above the piston plate. With the arrangement of Sperry, however, a second vent valve is also required to close off a counter-sunk valve seat in the main cylinder body, in cooperation with the first valve means, in order for vacuum to be produced.

The first valve means of Sperry is a complex arrangement of toothed upper and lower cams having slots in an outer periphery thereof for engaging an index pin, and a pair of biasing springs, all located within the upper end of the tubular piston rod, and therefore movable with the piston plate and piston rod. Actuation of the first valve means of Sperry is accomplished through relative movement of the plunger rod with respect to the tubular piston rod, as the lifting device is raised and lowered, by virtue of axial movement of the cylindrical pin connector within the slotted openings of the tubular piston rod.

Although the lifting device of Sperry eliminates the disadvantages of the rolling diaphragm of Glanemann, and does so without having the valve seal of the first valve means be load bearing, as was necessary with the arrangement of Engelen, the approach of Sperry does so through the use of an even more complex valve arrangement moving with the piston plate and piston rod, and buried deeply therewithin, in such a manner repair and replacement of the control valve, once again, cannot be accomplished without total disassembly of the lifting device of Sperry. Furthermore, as was the case with the lifting devices of Engelen and Glanemann, the tubular piston rod and plunger arrangements required by the first valve means of Sperry must be load-bearing. The need for locating the first valve means within the piston rod, thereby requiring the piston rod to be a hollow tube, and the further need for providing the slotted openings and plunger arrangement connected with the connecting pin in Sperry, significantly reduce the load carrying capability of a lifting device of the type taught by Sperry.

Furthermore, in addition to the disadvantages discussed above, the arrangement of Sperry requires the second valve means to generate vacuum for lifting the load. The necessity for the second valve, together with the highly complex nature of the first valve means of Sperry, add considerable additional complexity to the overall construction and operation in a manner increasing the size dead-weight, and cost of a lifting device, according to Sperry, together with an attendant reduction in reliability.

What is needed, therefore, is an improved method and apparatus for effectively, efficiently, and safely constructing and/or utilizing a vacuum lifting device.

BRIEF SUMMARY OF THE INVENTION

The invention provides an improved method and apparatus for vacuum-assisted lifting of a work piece or other object, through use of a lifting apparatus having a cylinder housing adapted at an upper end thereof for supporting a load, a piston rod moveable within the cylinder housing and having a lower exposed end thereof adapted for attachment to a suction cup device, and a non-load bearing piston valve attached to the housing and operatively connected to be moved between an open and a closed position thereof by movement of the piston rod with respect to the housing.

In one form of the invention, a vacuum-assisted lifting apparatus includes, a housing defining a cylinder bore, components movable within the cylinder bore for selectively generating a vacuum, and a non-load bearing control valve not mounted on the components movable within the cylinder bore, but disposed for intermittent operative contact with one of the components movable within the cylinder bore, for controlling generation of the vacuum in the cylinder bore. The control valve may be configured and connected for removal thereof from the lifting apparatus without disassembling other components of the lifting apparatus. The control valve may be mounted external to the cylinder bore. By having the control valve removable without disassembly of other components of the lifting apparatus, and/or mounted external to the cylinder bore, initial construction, and maintenance are significantly enhanced over prior lifting devices.

The invention may take the form of a vacuum-lifting apparatus, having a self-contained load bearing lift structure, and a non-load bearing control valve attached to the lift structure, for lifting a load when a lifting force is applied to the lifting apparatus on a lifting stroke of the lifting force, and for automatically releasing the load at the end of the load lifting stroke when the load is lowered onto a support, to thereby allow the lifting apparatus to be lifted off of the load by application of the lifting force during a successive non-lifting stroke of the lifting force. The self-contained, load bearing, lift structure may include relatively movable elements thereof operatively connected to one another in a manner selectively generating, or not generating, a vacuum for respectively gripping or not gripping the load as the lifting force is applied to the lift structure. The non-load bearing control valve may be attached to the lift structure by a non-load bearing valve support housing, and operatively connected to be actuated by movement of at least one of the relatively movable elements of the lift structure on successive applications of the lifting force to the lift structure, in a manner causing the lift structure to generate vacuum on the load lifting stroke, and to not generate vacuum on the successive non-lifting stroke.

The control valve may be a mechanically actuated latching valve, and may be removable from the lift structure without disassembly of the lift structure. The mechanically actuated latching valve may include one or more positioning cams, defining HIGH and LOW position for a cam follower, operatively connected to the movable sealing member for moving the seal member in a manner causing the lift structure to generate vacuum on the load lifting stroke and to not generate vacuum on the successive non-lifting stroke, by action of the at least one of the relatively movable elements of the lift structure. These elements are interconnected in such a manner that, in the HIGH position, the sealing member is positioned in such a manner that vacuum is not generated, regardless of the relative position of the relatively movable elements of the lift structure, and in the LOW position, the sealing member is position in such a manner that vacuum is generated by relative movement of the relatively movable elements of the lift structure.

A mechanically actuated latching valve, according to the invention, may be removable from the lift structure without disassembly of the lift structure. The lift structure may define an exterior surface thereof, with the control valve and valve support housing being located external to the lift structure and attached to the exterior of the lift structure.

The cylinder housing, of a lifting apparatus according to the invention, may define a valve seat surrounding a port extending through the cylinder housing, with the control valve being a mechanically actuated latching valve including one or more positioning cams, defining HIGH and LOW positions for a cam follower, operatively connected to a movable sealing member for moving the seal member in to and out of contact with the valve seat, by action of at least one of the relatively movable elements of the lift structure. Operative connection between the movable element of the lift structure and the elements of the latching valve is accomplished in such a manner that in the HIGH position, the seal member is held away from the valve seat such that vacuum is not generated, regardless of the relative position of the relatively movable elements of the lift structure, and such that in the low position, the seal member is released to rest sealing upon the valve seat in such a manner that vacuum is generated by relative movement of the relatively movable elements of the lift structure.

A lift structure, of a lifting apparatus according to the invention, may include a cylinder housing adapted for receiving the lifting force, and at least one movable element that is movable relative to the cylinder housing as lifting force is applied to the cylinder housing, to thereby define a variable fluid cavity for selectively generating a vacuum. The valve support housing, of a control valve, according to the invention, may be fixedly attached to the cylinder housing, with the control valve including a movable seal member thereof configured for intermittent operative contact with the at least one movable element of the lift structure during each of the successive load-lifting and non-lifting stroke applications of lifting force to the cylinder housing, with the movable seal members sealing and unsealing the variable fluid cavity on successive load-lifting and non-lifting stroke applications of the lifting force to the cylinder housing. The control valve may be configured in such a manner that it latches the movable seal member in a closed position thereof, during the entirety of the load-lifting stroke, and latches the movable seal member in an open position thereof during the entirety of the non-lifting stroke.

In a lifting apparatus, according to the invention, the control valve may be mounted to the exterior of the cylinder housing, with the movable seal member of the control valve disposed exterior to the cylinder housing, and at least one movable element of the lift structure configured to intermittently extend through the cylinder housing for operatively contacting the movable seal member of the control valve, to thereby alternately cycle the moveable seal member between open and closed positions of the movable seal member between open and closed positions of the movable seal element on successive intermittent operative contact with the movable element of the lift structure with the movable sealing member of the control valve. The control valve may latch the movable seal member in the closed position during the entirety of the load-lifting stroke, and may further latch the movable seal member in the open position during the entirety of the non-lifting stroke.

In some forms of a lifting apparatus, according to the invention, the cylinder housing defines a lifting axis and a cylinder bore extending along the lifting axis, with the lift structure further including a piston having an axial thickness thereof, a suction cup device, and a piston rod. The piston has an axial thickness thereof, with the piston being sealingly disposed in the cylinder bore and movable axially with respect to the cylinder bore along the lifting axis, with the piston and cylinder bore in combination defining the sealed fluid cavity.

The suction cup device is adapted for gripping the load and operatively connected in fluid communication with the fluid cavity.

The piston rod has first and second ends thereof, with the suction cup device being attached to the second end, and the first end sealingly extending through the piston, for limited sliding movement through the piston between upper and lower piston rod travel stops axially spaced a rod travel distance apart. The piston rod is connected to the piston in such a manner that the piston rod urges axial movement of the piston in the cylinder bore when the piston is contacting either the upper or the lower rod travel stops while a substantially axially directed force is being applied to the piston rod, and such that the piston rod may slide through the piston and extend through the cylinder housing for operatively contacting and moving the movable sealing element of the control valve to the closed position thereof at the beginning of a load-lifting stroke, and successively operatively contacting and moving the movable sealing member of the control valve to the open position thereof at the end of the load-lifting stroke.

In one form of the invention, a non-load bearing, latching piston valve is attached at an upper end of the housing, and adapted for movement between an open and a closed position thereof when contacted by an upper end of the piston rod, on successive strokes of the piston rod. A piston valve, according to the invention, may include a seal, which is vertically moveable in to and out of contact with a valve seat, by the action of the upper end of the piston rod, and one or more positioning cams defining HIGH and LOW positions for a cam follower operatively connected to the seal. In the HIGH position, the seal is held away from the valve seat in such a manner that the cylinder is vented to atmosphere, regardless of the position of the piston rod within the cylinder housing. In the LOW position of the piston valve, the seal is released to rest sealingly upon the valve seat, in such a manner that an area within the cylinder housing is sealed from the atmosphere regardless of the position of the piston rod within the cylinder housing.

In some forms of the invention, the piston rod includes a longitudinally directed passage therein, allowing fluid communication between a cavity within the cylinder housing above the piston rod and vacuum ports at the exposed end of the piston rod.

Some forms of an apparatus, according to the invention, include a piston attached to the upper end of the piston rod for movement therewith inside of the cylinder housing. Sliding seals extending from the piston may be provided for operatively sealing a juncture between the piston and an inner surface of the cylinder housing. A piston, according to the invention, may be operatively attached to the piston rod for limited sliding motion with respect to the piston rod, in such a manner that after the piston has reached an upper limit of travel within the cylinder housing, the piston rod may move a further distance relative to the piston, for engaging with, and disengaging from, the non-load bearing, latching piston valve. The relative motion of the piston rod with respect to the piston, thus provided, allows the overall length of the cylinder housing to be shortened.

A lifting apparatus, according to the invention, may also include automatic locking devices, such as spring loaded detents, for holding the piston rod in a partially extended position when the lifting apparatus has released the load and is being lifted away.

A lifting apparatus, according to the invention, may also include one or more vacuum indicator devices, providing a visual indication of the presence of vacuum within the vacuum lifting apparatus. In some forms of the invention, an indicator device may provide graduated indications of the amount of lifting vacuum available. Such graduations may include color coding.

A method and/or apparatus, according to the invention, may be utilized for providing vacuum to single or multiple suction cups or vacuum pads.

The invention may also take the form of a method for operating or fabricating a vacuum lifting apparatus, in accordance with the invention, or component parts thereof.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
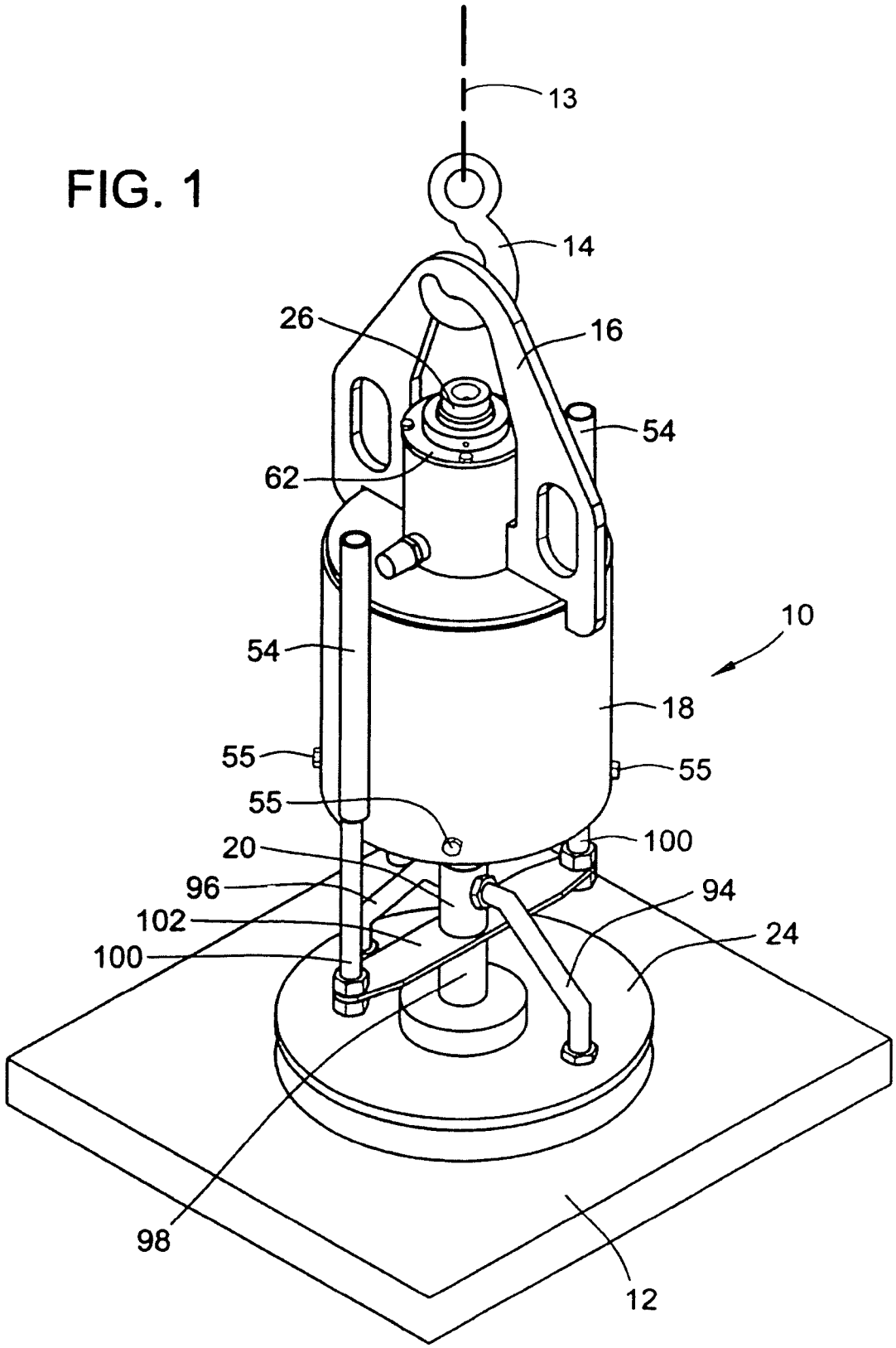
FIG. 1 is a perspective view of an exemplary embodiment of a vacuum lifting apparatus, according to the invention, shown connected at an upper end thereof to a cable hook of a crane apparatus, and having a single vacuum pad at a lower end thereof attached to and lifting a plate.

FIG. 1 shows an exemplary embodiment of the invention in the form of a vacuum lifting apparatus 10, for providing vacuum-assisted lifting of a work piece, in the form of a plate 12, through application of a lifting force along a central, vertical lifting axis 13 by a crane, illustrated by a lifting hook 14 attached to a lifting bale 16 at an upper end of the vacuum lifting apparatus 10. The lifting apparatus 10 includes a cylinder housing 18 having the bale 16 extending from an upper end of the housing 18 for supporting the load 12.

Figure 2:
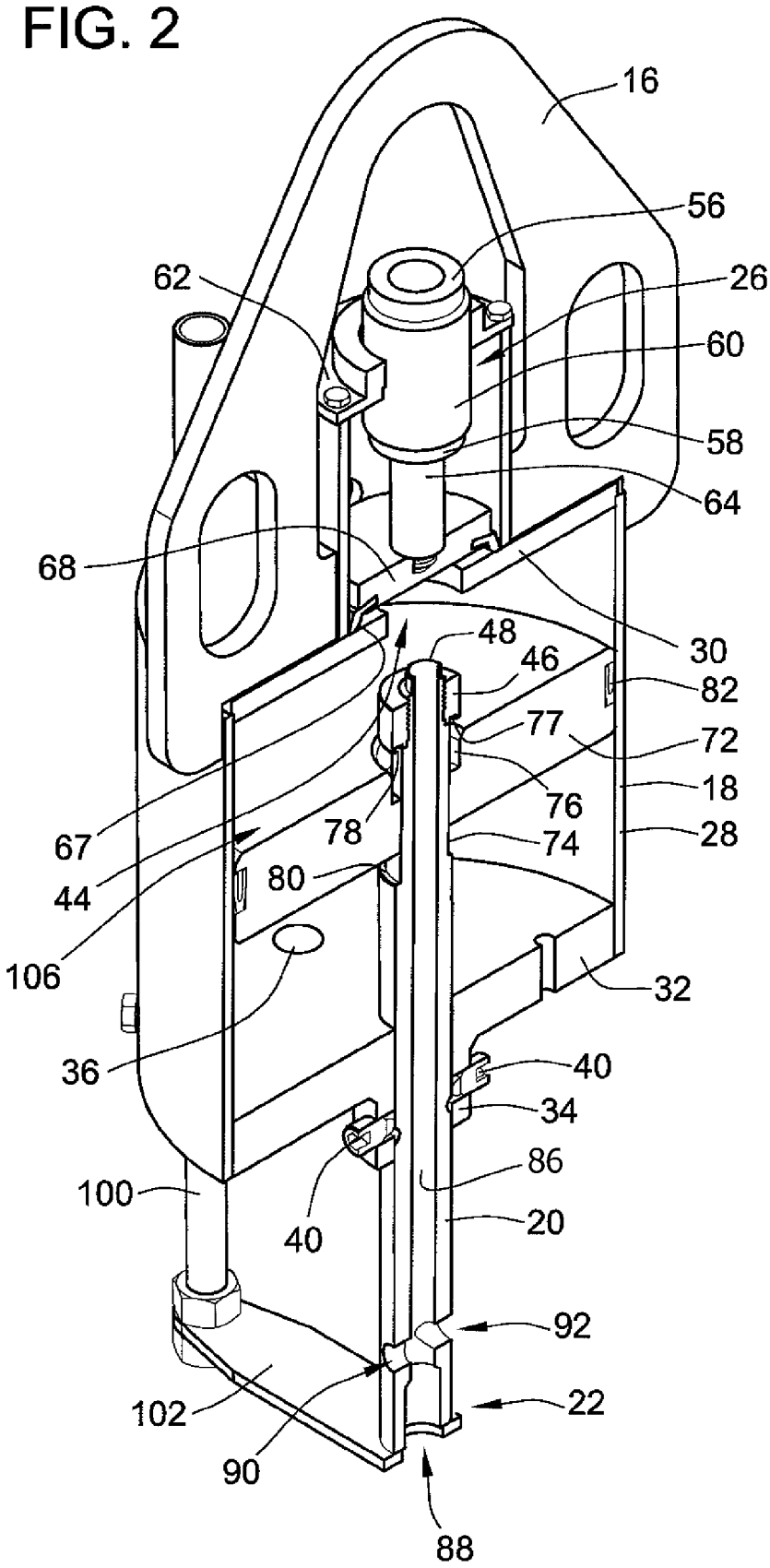
FIG. 2 is a perspective cross section, of the exemplary embodiment illustrated in FIG. 1, cut along the edge of a lifting bale.
Figure 3:
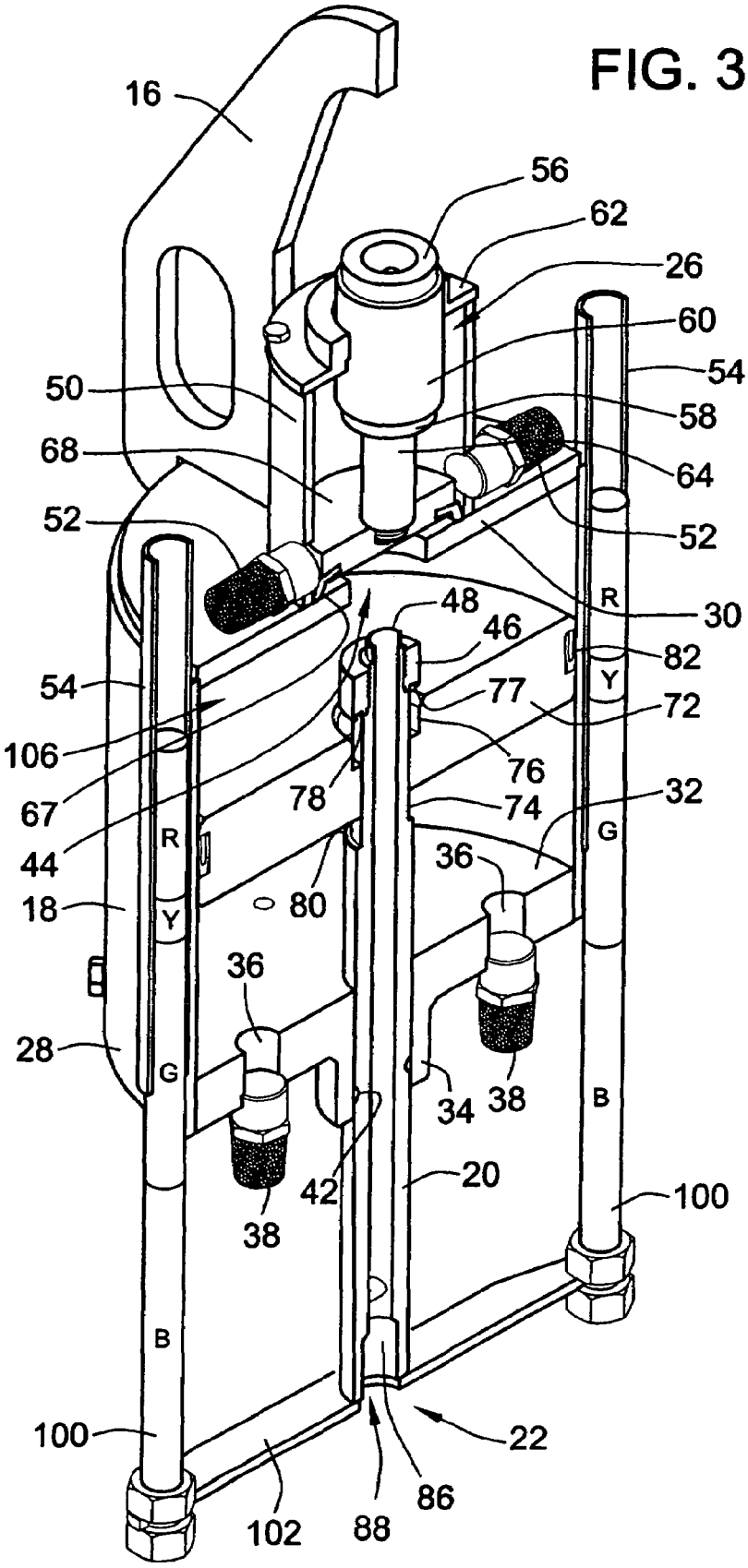
FIG. 3 is a perspective cross sectional view of the exemplary embodiment of the lifting apparatus, according to the invention, shown in FIGS. 1 and 2, cut substantially 90° to the view shown in FIG. 2.

As shown in FIGS. 1-3, the vacuum lifting apparatus 10 of the exemplary embodiment of the invention further includes a piston rod 20 moveable within the cylinder housing 18 and having a lower end 22 thereof adapted for attachment to a suction cup device in the form of a single vacuum lifting pad 24.

The exemplary embodiment of the vacuum lifting apparatus 10 also includes a non-load bearing, latching piston valve 26, which is attached at the upper end of the cylinder housing 18, and operatively connected to be moved between an open and a closed position of the piston valve 26 by movement of the piston rod 20 with respect to the cylinder housing 18.

As shown in FIGS. 1-3, the cylinder housing 18 of the exemplary embodiment includes a right-circular shaped cylindrical section 28 closed at a top end thereof by a top plate 30 and closed at a bottom end thereof by a bottom plate 32. The bottom plate 32 includes a central boss 34 having a throughbores for passage and support of the piston rod 20. The bottom plate 32 also includes several additional throughbores for passage of air into the lower end of cylinder housing 18, with two of the additional throughbores 36 being threaded for receiving a pair of breathers 38. As best seen in FIG. 2, the central boss 34 of the bottom plate 32 of the exemplary embodiment is also adapted for receiving a pair of spring-loaded ball detents 40 for engaging a detent groove 42 and the piston rod 20, with the detent groove 42 being best seen in FIG. 3.

The top plate 30 of the cylinder housing 18 includes a central through hole 44, therein, for passage therethrough of a nut 46 attached to an upper end 48 of the piston rod 20. A valve support pipe 50 is disposed about the central through hole 44 and the top plate 30 and extends upward away from the top plate 30. The valve support pipe 50 is also drilled and tapped to receive a pair of breathers 52, for filtering air passing into and out of the valve support pipe 50.

As shown in FIG. 1, the cylinder housing 18 of the exemplary embodiment also includes a pair of indicator guide tubes 54 attached to the cylindrical section 28 of the cylinder housing 18. In the exemplary embodiment shown in FIGS. 1-3, the lifting bale 16, the top plate 30, the valve support pipe 50, and the indicator guide tubes 54 are joined into a common welded assembly. The bottom plate 32 of the exemplary embodiment of the cylinder housing 18, is joined to the lower end of the cylindrical section 28 of the housing 18 by a plurality of threaded fasteners 55, in order to facilitate manufacture and maintenance of the vacuum lifting apparatus 10.

As shown in FIGS. 2, 3, and 4A-4B, the latching piston valve 26, of the exemplary embodiment, includes upper and lower cams 56, 58 fixedly attached in the upper and lower ends, respectively, of an auto-latch housing 60. As shown in FIGS. 2 and 3, a valve mounting flange 62 extends from the auto-latch housing 60 for a bolted attachment of the valve mounting flange to the upper end of the valve support pipe 50, in such a manner that the piston valve 26 is properly positioned and retained within the valve support pipe 50.

Figure 4C:
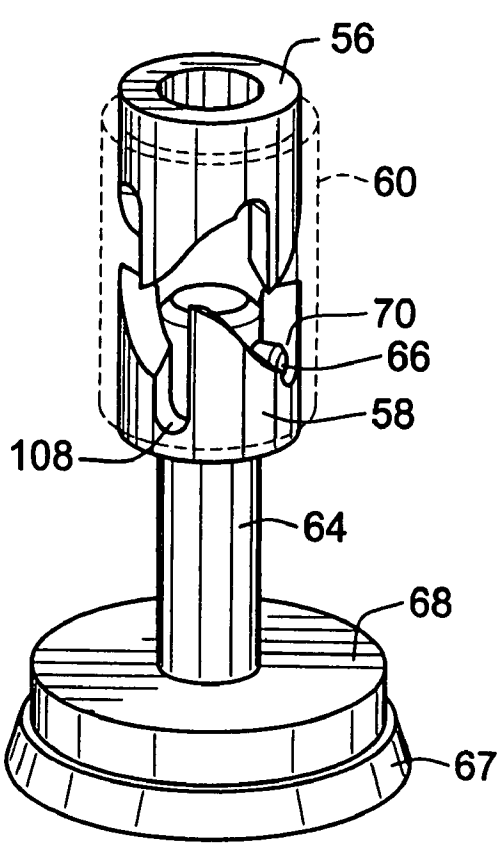
FIGS. 4A-4C are perspective schematic illustrations of a non-load bearing, latching piston valve of the exemplary embodiment of the invention shown in FIGS. 1-3, with FIG. 4A showing a seal of the valve in a closed position, FIG. 4B showing a seal of the valve in an open position, and FIG. 4C showing the seal of the valve in an actuation position and transitioning from the closed position of FIG. 4A to the open position of FIG. 4B.
Figure 4B:
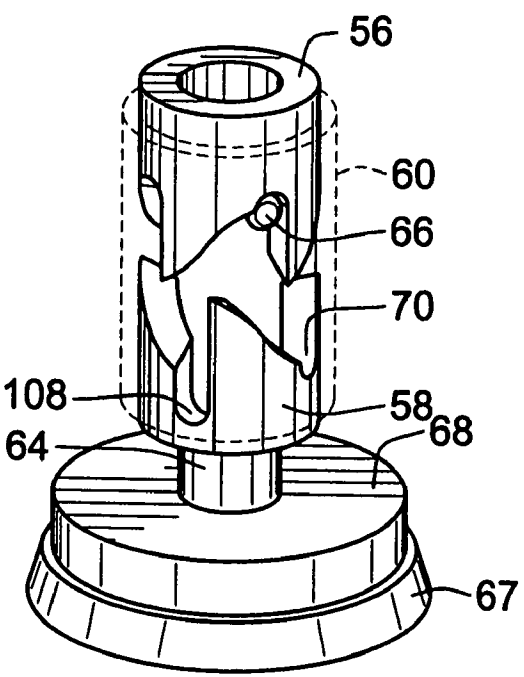
Figure 4A:
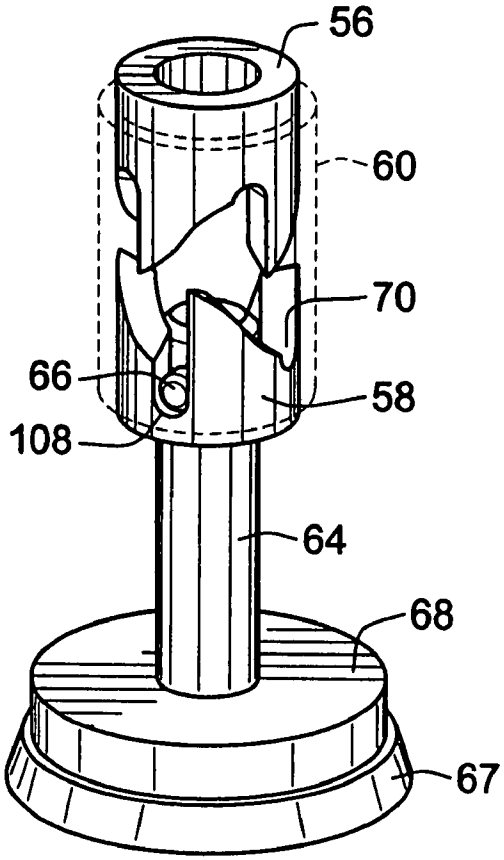
Figure 5A:
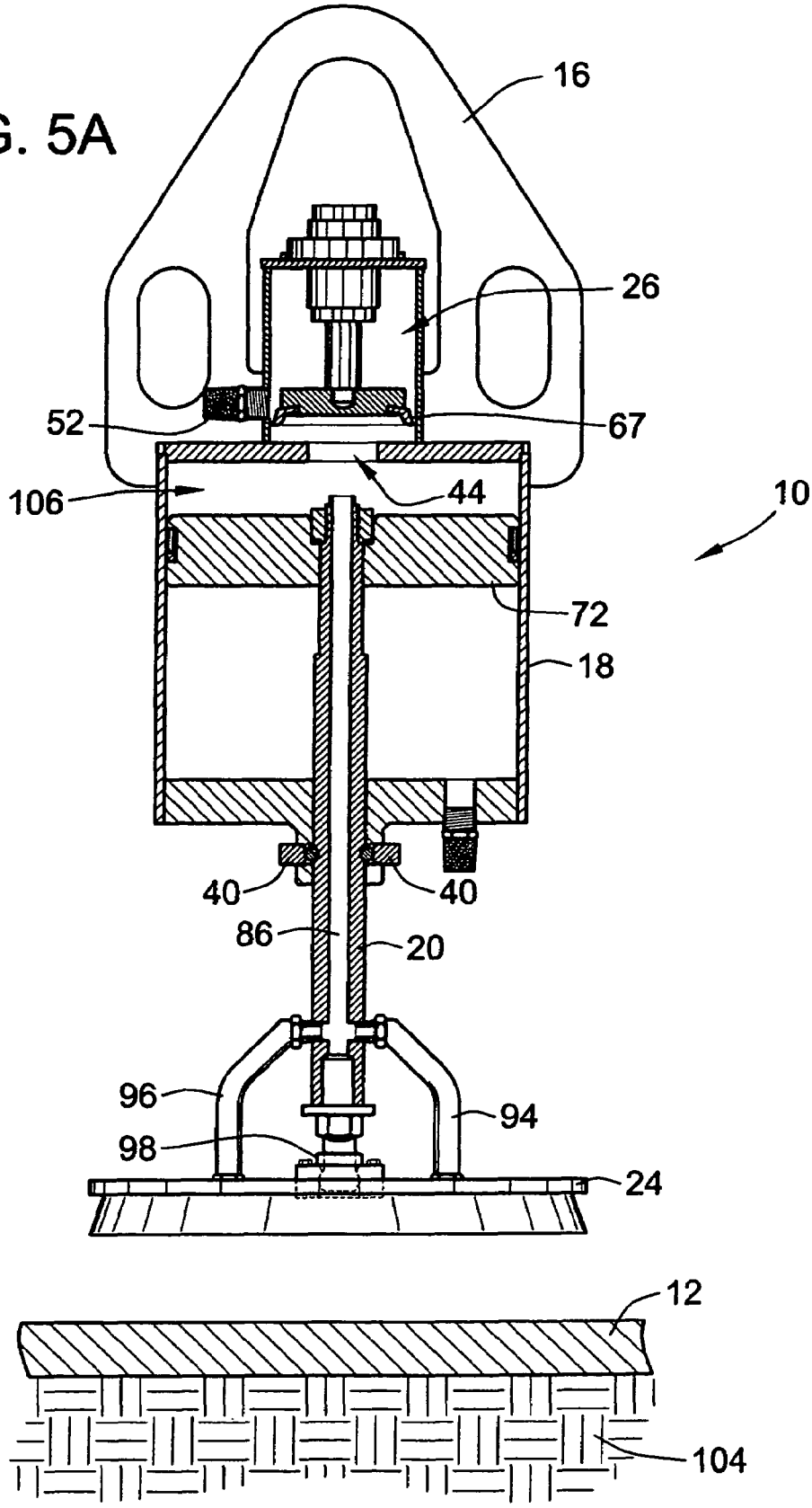
FIGS. 5A-5E are schematic cross sectional views of the exemplary embodiment of the lifting apparatus shown in FIGS. 1-3, in various stages of a lift and release cycle.

As shown in FIGS. 4A-4C, the upper and lower cams 56, 58 include aligned throughbores therein for vertically sliding receipt of an auto-latch pin 64. A cam follower pin 66 extends through a cross bore in the upper end of the auto-latch pin 64 for engagement with ramp surfaces on the upper and lower cams 56, 58 and for retaining the auto-latch pin 64 in the throughbores of the upper and lower cams 56, 58. A face seal 67 is attached to the lower end of the auto-latch pin 64 by a seal support 68, in such a manner that when the piston valve 26 is placed in a closed position, as shown in FIGS. 2, 3, 4A, 5C, 5D, and FIG. 6, the seal 67 prevents the passage of air through the central throughhole 44 in the top plate 30 of the cylinder housing 18. As shown in FIG. 4B, the lower cam 58 includes a ramp defining an upper resting notch 70 for receipt therein of the cam follower pin 66 in a manner that holds the piston valve 26 in an open position as shown in FIGS. 5A and 5E, which allows air to flow freely through the central bore 44 and the top plate 30 of the cylinder housing 18.

As shown in FIGS. 2 and 3, the exemplary embodiment of the lifting apparatus 10, according to the invention, further includes a piston 72 having a central bore therein appropriately sized for a sliding fit on a reduced diameter section 74 of the piston rod 20 extending from the upper end 48 of the piston rod 20. The upper face of the piston 72 also defines a central counterbore 76 therein for receiving the nut 46 on the upper end of the piston rod 20. A bottom surface of the counterbore 76 and the piston 72 is further configured to seal against a seal 77 disposed in a trepan groove 78 in the bottom surface of the nut 46, in such a manner that when the seal 77 is engaging the bottom surface of the counter bore 76, no air can flow between the piston rod 20 and the piston 72.

By virtue of the above-defined construction, the piston 72 may slide a limited rod-travel distance along the reduced diameter section 74 of the piston rod 20, bounded on an upper end thereof by an upper piston rod travel stop, in the form of the bottom surface of the nut 46 and on a lower end by a lower piston rod travel stop, in the form of shoulder 80 formed by the reduced diameter section 74.

The piston 72 also includes an outer peripheral groove, for receipt therein of a peripheral piston seal 82, which provides a sliding seal between the piston 72 and an inner surface of the cylindrical section 28 of the cylinder housing 18, so that no air can pass between the outer periphery of the piston 72 and the inner surface of the cylindrical section 28 of the housing 18.

As shown in FIGS. 2 and 3, the piston rod 20 of the exemplary embodiment further includes an axial throughbore 86 extending entirely through the piston rod 20 from the upper to the lower ends 48, 22 thereof, to provide fluid communication between a cavity 106 within the cylinder housing 18 above the piston 72 and a plurality of vacuum ports 88, 90, 92 disposed at or adjacent the lower end 22 of the piston rod 20. As shown in FIG. 1, in the exemplary embodiment of the invention, vacuum conduits 94, 96, 98 connect the vacuum ports 88, 90, 92 to the vacuum pad 24, for operatively applying a vacuum generated in the upper end of the cylinder housing 18 above the piston 72, to a lower surface of the vacuum pad 24, for creating a suction between the vacuum pad and the load 12.

In other embodiments of the invention, the axial throughbore 86 may be eliminated, with fluid communication between the upper cavity 106 and the vacuum pad 24 by an extended vacuum conduit or hose, such that the piston rod 20 may be solid for increased load carrying capacity.

As best seen in FIG. 3, the exemplary embodiment of the lifting apparatus 10 also includes a pair of indicator rods 100 having upper ends thereof slidingly disposed in the indicator guide rods 54 of the cylinder housing 18, and having lower ends thereof joined to one another and the lower end 22 of the piston rod by a spanner bar 102. As illustrated by graduations and letters on the indicator rods 100 in FIG. 3, the indicator rods include colored sections thereof (i.e. black B, green G, yellow Y, and red R), moving successively from a lower to an upper end of each of the indicator rods 100. By virtue of this arrangement, the spanner bar 102 causes the indicator rods 100 to move in unison up and down with the piston rod 20. The colored sections of the indicator rods 100 become successively visible as the indicator rods 100 extend farther below the bottom edge of the indicator guide tubes 54, to thereby provide an operator with a visual indication of the vacuum available within the cylinder housing 18 during lifting operations.

Operation of the exemplary embodiment of the vacuum lifting apparatus 10 will now be described in relation to FIGS. 5A-5E.

FIG. 5A shows a preferred position of the various components of the lifting apparatus 10, with the apparatus 10 being suspended above the work piece 12 by a lifting device (not shown) attached to the bale 16 of the lifting apparatus 10, while the load 12 is still supported on a support surface 104. In this position, the piston valve 26 is in the open position, with the cam follower pin 66 in the upper resting notch 70 of the lower cam 58, so that air may flow around the outer periphery of the seal 67 and through the breather 52 and central hole 44 into the upper cavity 106 of the cylinder housing 18 in the area above the piston 72. It will be further understood that air may also flow into the upper cavity 106 through the throughbore 86 in the piston rod 20 and the conduits 94, 96, 98 to the lower surface of the lifting pad 24.

It will be further noted, that in the position illustrated in FIG. 5A, the piston rod 20 is locked against further downward movement caused by the combined weight of the piston rod 20, the piston 72, the lifting pad 24, and the conduits 94, 96, 98 by engagement of the spring-loaded ball detents 40 with the detent groove 42 and the piston rod 20.

Figure 5B:
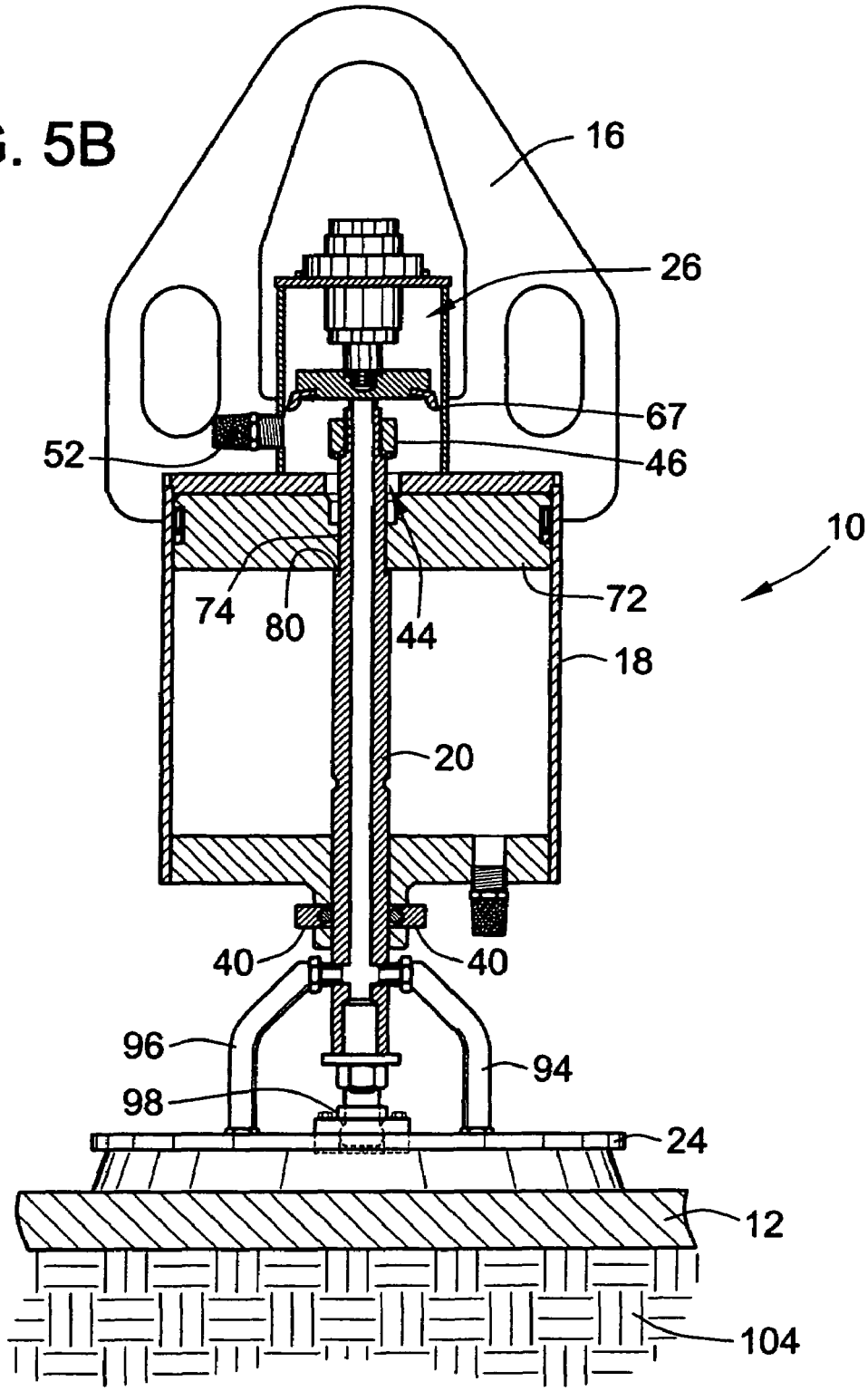
Figure 5C:
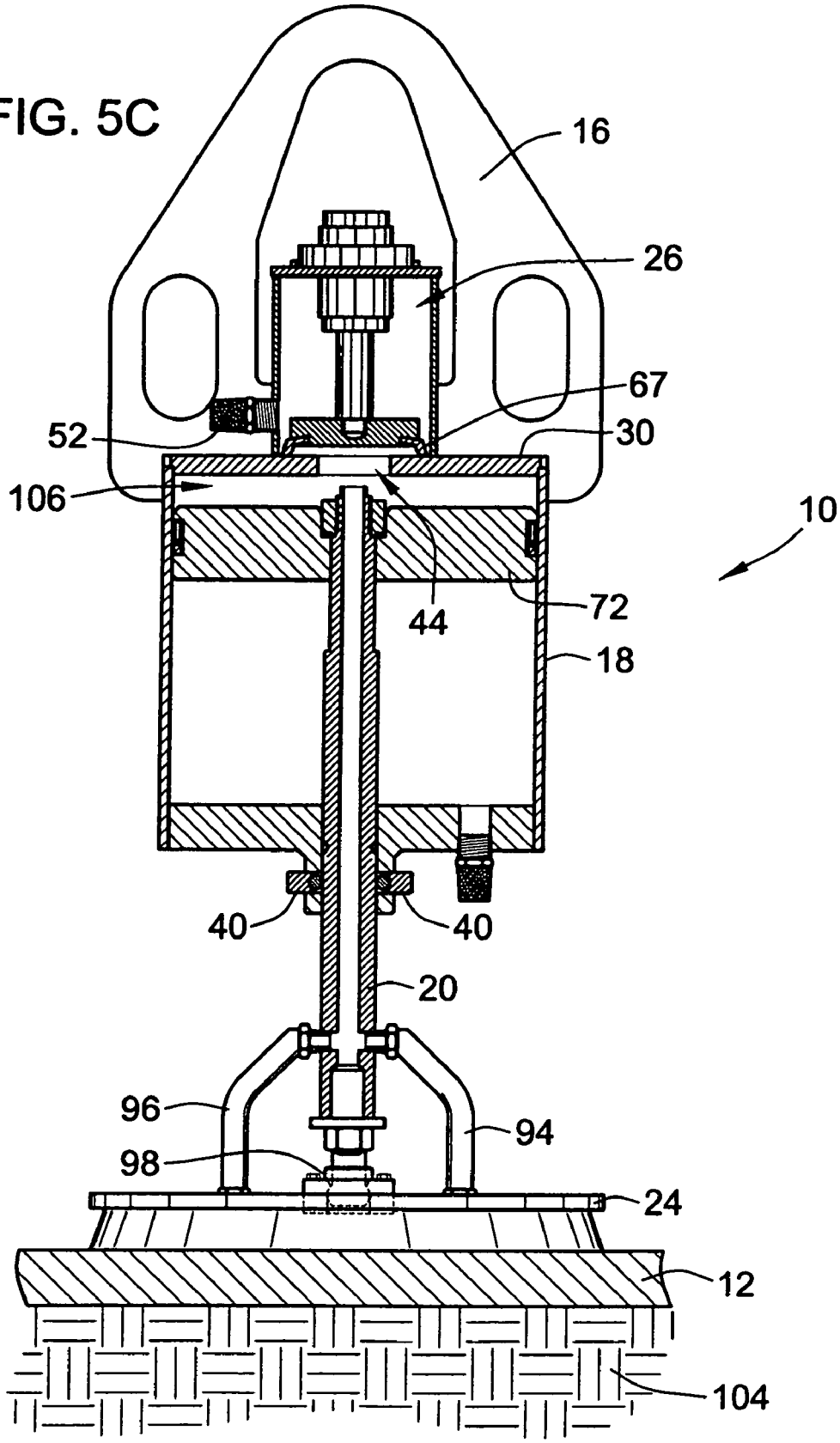

As shown in FIG. 5B, as the lifting apparatus 10 is further lowered so that the lifting pad 24 comes into contact with the load 12, the assembly formed by the lifting pad 24, the conduits 94, 96, 98, the piston rod 20, and the nut 46 come to rest before the assembly formed by the cylinder housing 18, the piston valve 26, and the piston 72, so that the upper end of the piston rod 20 protrudes through the central hole 44 in the top plate 30 of the cylinder housing 18, and the piston 72 is forced downward along the reduced diameter section 74 of the piston rod 20 toward the shoulder 80 of the piston rod 20.

As the upper end of the piston rod 20 moves through the central hole 44 and the top plate 30, the seal 67 is lifted away from the valve seat provided by the upper surface of the top plate 30, to the actuation position of the cam follower pin 66 against the upper cam 56 of the piston valve, as shown in FIG. 4C. As will further be understood by an examination of FIG. 4C, the upper cam 56 includes a ramp surface which engages the cam follower pin 66 after it is lifted out of a lower resting notch 108 in the lower cam 58, in such a manner that as the seal 67 is moved further upward by relative motion between the piston rod 20 and the cylinder housing 18, the interaction between the ramp on the upper cam 56 and the cam follower pin 66 causes the auto-latch pin 64 to rotate in such a manner that when the upper end of the piston rod 20 disengages from the lower surface of the seal support 68, corresponding ramp surfaces in the upper and lower cams 56, 58 will have guided the cam follower 66 from the upper resting notch 70, as shown in FIG. 4B, to the lower resting notch 108, as shown in FIG. 4A.

With the cam follower 66 resting in the lower resting notch 108 of the piston valve 26, the piston valve 26 is placed into a closed position with the seal 67 contacting a seat surface on the upper side of the top plate 30 to thereby block air from flowing into the upper cavity 106 of the cylinder housing 18 through the central hole 44 and the top plate 30, as lifting force is applied to the bale 16 of the lifting apparatus 10. With the piston valve 26 closed, as the cylinder housing 18 is lifted away from the load 12, and the vacuum pad 24 engaging the upper surface of the load, the piston rod 20 begins to pull the piston 72 downward, and, by virtue of the fact that the upper cavity 106 is now closed by the valve 26, a vacuum is generated within the upper cavity 106. The vacuum generated in the upper cavity 106 is communicated through the hollow piston rod 20 and conduits 94, 96, 98 to the lower side of the lifting pad 24 to establish a considerable suction force between the lifting pad 24 and the load 12.

Figure 5D:
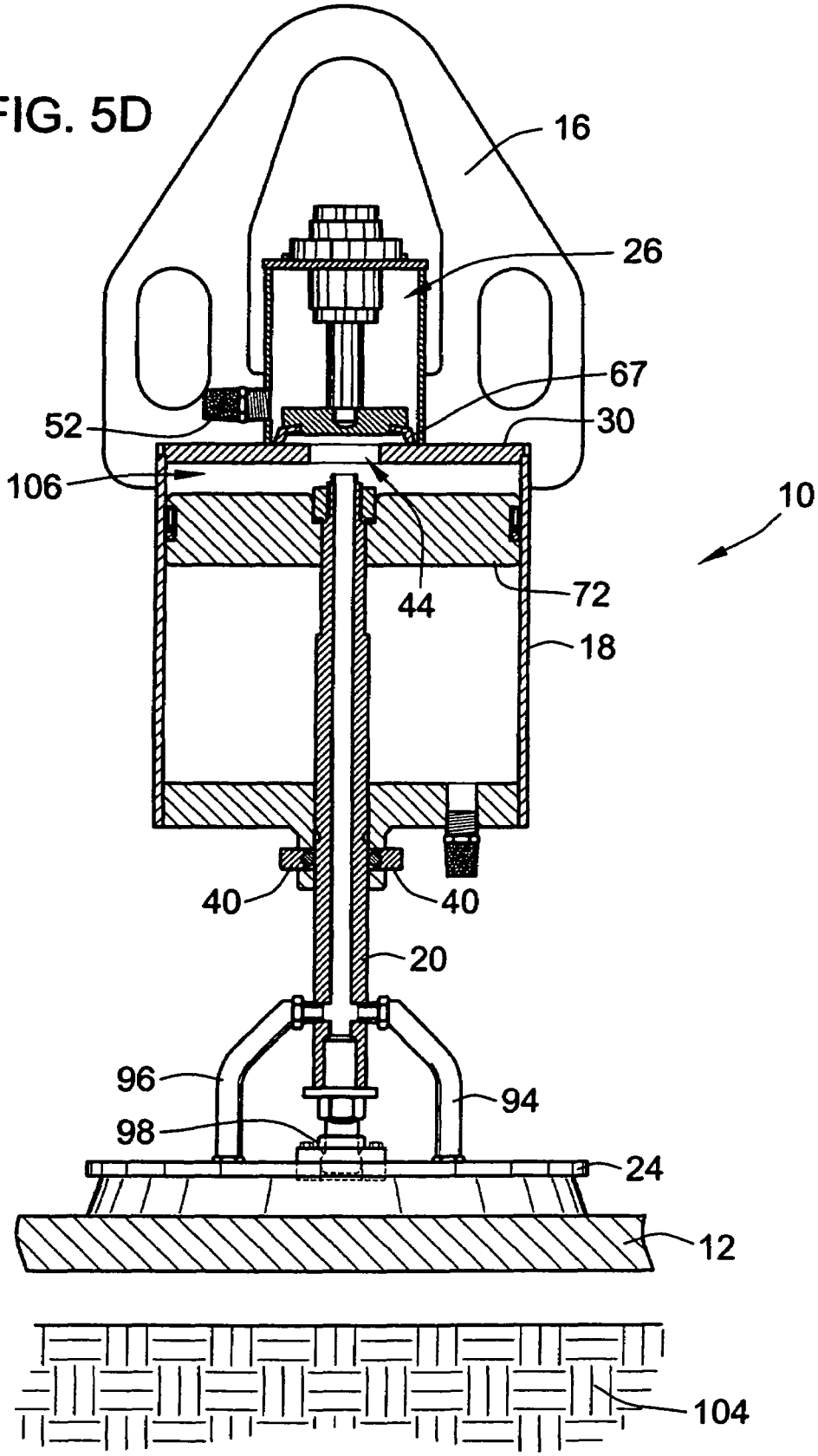
Figure 5E:
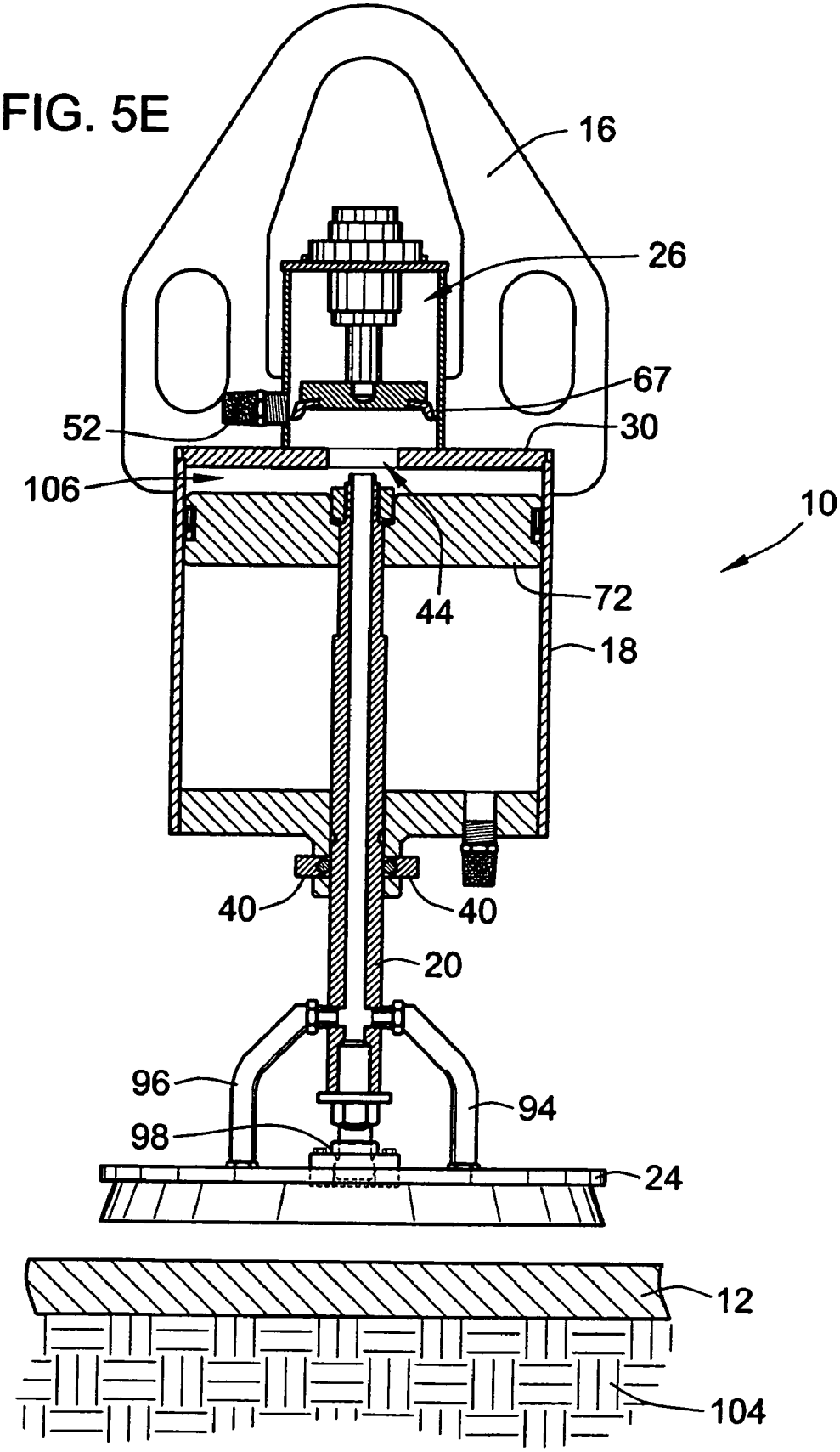

As shown in FIG. 5D, as continued lifting force is applied to the bale 16, the suction force generated in the upper cavity 106 and communicated to the lower side of the vacuum pad 24 cause the vacuum pad 24 to grip the load 12 tightly enough that the load 12 can be lifted free of the supporting surface 104 by the lifting apparatus 10.

After the load 12 has been repositioned to a desired location, the sequence of steps previously described with regard to FIGS. 5B and 5C is reversed by lowering the load 12 onto a support surface 104. Specifically, as the load 12 is lowered, the lifting apparatus 10 will retain the configuration shown in FIG. 5C as the load 12 is brought into initial contact with the supporting surface 104. As lifting force is continually removed from the bale 16 of the lifting apparatus 10, the combined weight of the cylindrical housing 18, piston valve 26, and piston 72 will cause those parts to continue moving in a downward direction after the vacuum pad 24 and piston rod 20 connected thereto have come to rest upon the load 12 and supporting surface 104. By virtue of this relative movement between the various components of the lifting apparatus 10, the upper end of the piston rod 20 once again moves through the central hole 44 in the top plate 30 of the cylinder housing 18 and lifts the seal 67 off of the valve seat to the actuation position as illustrated in FIG. 5B. By virtue of the configuration of the ramp surfaces and resting notches 70, 108 of the upper and lower cams 56, 58 and their interaction with the cam follower pin 66, as the auto-latch pin 64 moves upward, the cam follower pin 66 is repositioned in such a manner that, when the lifting apparatus 10 is raised from the surface of the load 12, the cam follower pin 66 will move from the lower 108 to the upper 70 resting notch in the cams 56, 58 to thereby lock the piston valve in the open position. As the lifting apparatus 10 is further lifted away from the now released load 12, air may freely flow into the cylindrical housing 18 both above and below the piston 72 with the weight of the vacuum pad 24 and piston rod 20, and their associated components pulling the piston 72 and piston rod 20 downward through a transition position as shown in FIG. 5E, to the position illustrated in FIG. 5A, whereat the spring-loaded detents 40 once again engage the detent groove 42 in the piston rod 20 and prevent further extension of the piston rod 20 with respect to the cylinder housing 18.

Figure 6:
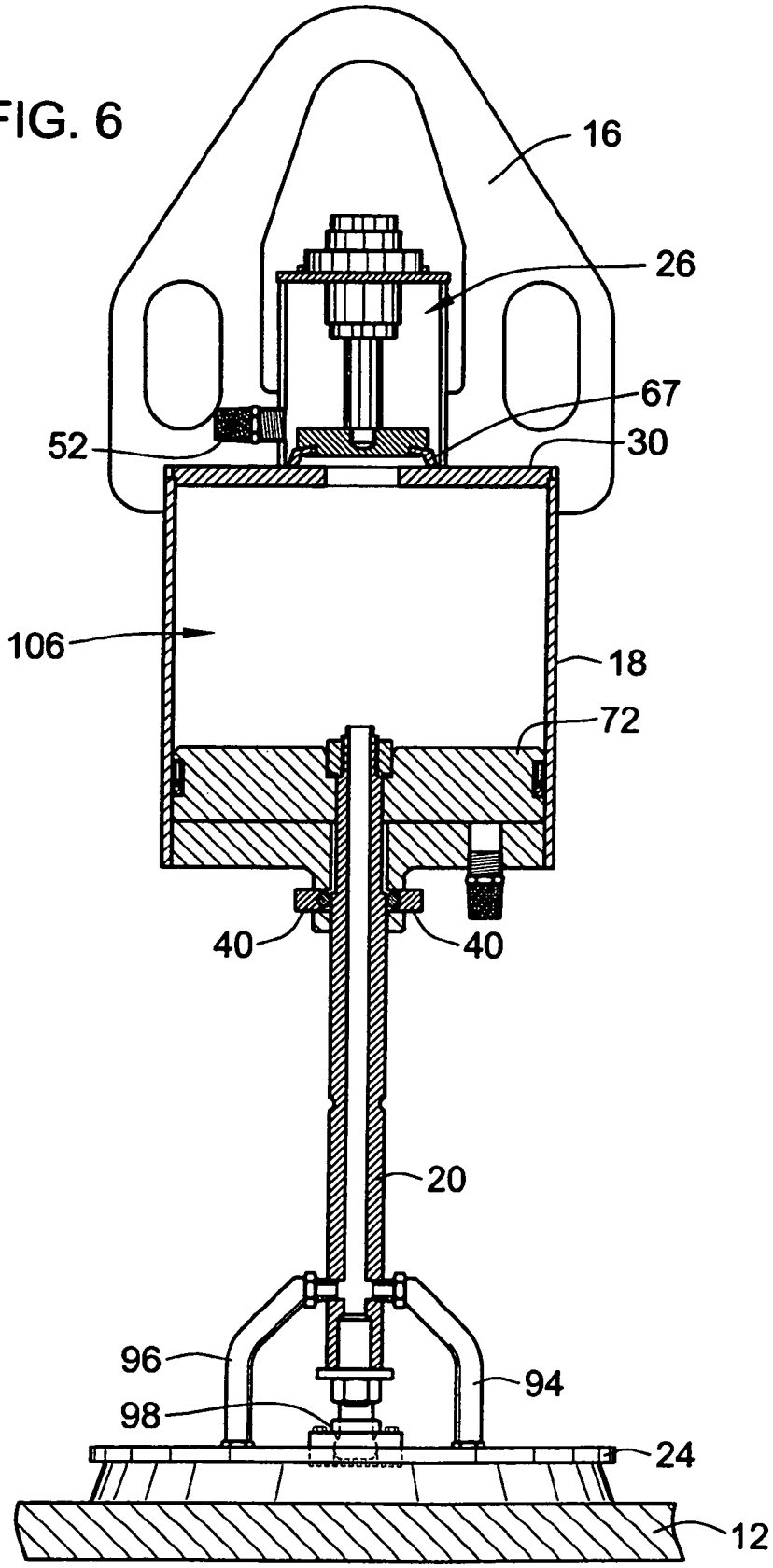
FIG. 6 is a schematic cross section, similar to those shown in FIGS. 5A-5E, illustrating the extent of the stroke of a piston rod of the exemplary embodiment of the invention shown in FIGS. 1-3.

It will be appreciated, by those having skill in the art, in light of the description above, that the arrangement of components in the exemplary embodiment of the lifting apparatus 10 causes the piston valve 26 to be moved sequentially between the closed and open positions and back again, on successive applications of lifting force to the bale 16, after the lifting apparatus 10 has been fully lowered onto the surface of the load 12, while it is resting on a support surface 104. In a lifting apparatus 10, according to the invention, therefore there is no need for an operator to take any action, or adjust any valves, for example, as was required in prior lifting apparatuses. A lifting apparatus according to the invention, also provides significant advantage over prior lifting apparatuses of the type utilizing rolling diaphragms, in that should a vacuum leak occur between the vacuum pad 24 and the surface of the load 12, or within the lifting apparatus itself, vacuum within the upper chamber 106 of the cylinder housing 18 will be maintained throughout a considerable range of additional stroke of the piston rod 20 and piston 72 as illustrated in FIG. 6. Furthermore, by virtue of the indicator rods 100 of the exemplary embodiment of the invention, an operator utilizing a lifting apparatus according to the invention will be made aware that vacuum is gradually being lost and will therefore be able to complete moving the load, or set it down in a safe location prior to total loss of suction between the vacuum pad 24 and the surface of the load 12.

Figure 7:
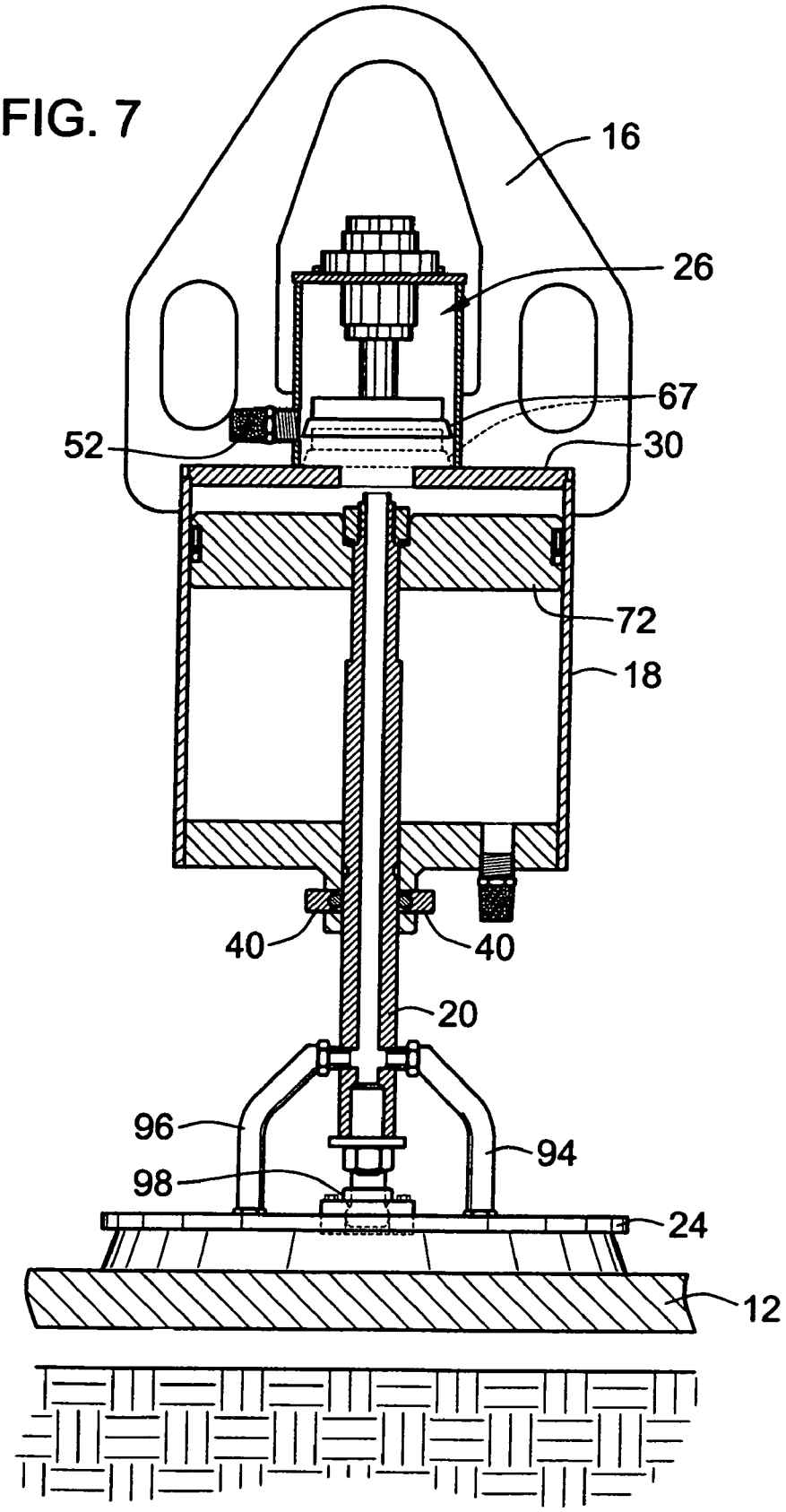
FIG. 7 is a schematic cross section, similar to the cross sections of FIGS. 5A-5E, illustrating alternative operating modes of the exemplary embodiment of the lifting apparatus shown in FIGS. 1-3.

As will also be understood by those having skill in the art, depending upon the manner in which a lifting apparatus, according to the invention, is stored between periods of use, the piston valve 26 may be latched into the closed position, as indicated by dashed lines in FIG. 7, rather than in the desired open position, as shown by solid lines in FIG. 7 and FIG. 5A. If such circumstances occur, those skilled in the art will further recognize that it will take two applications of lifting force with a release of lifting force therebetween to reposition the piston valve to the closed position during the second of those applications of lifting force to generate a vacuum and lift the load away from the support surface. Once the piston valve has been reset in this manner, sequential lift and release cycles may be performed without further extra cycles to rest the piston valve.

Figure 8:
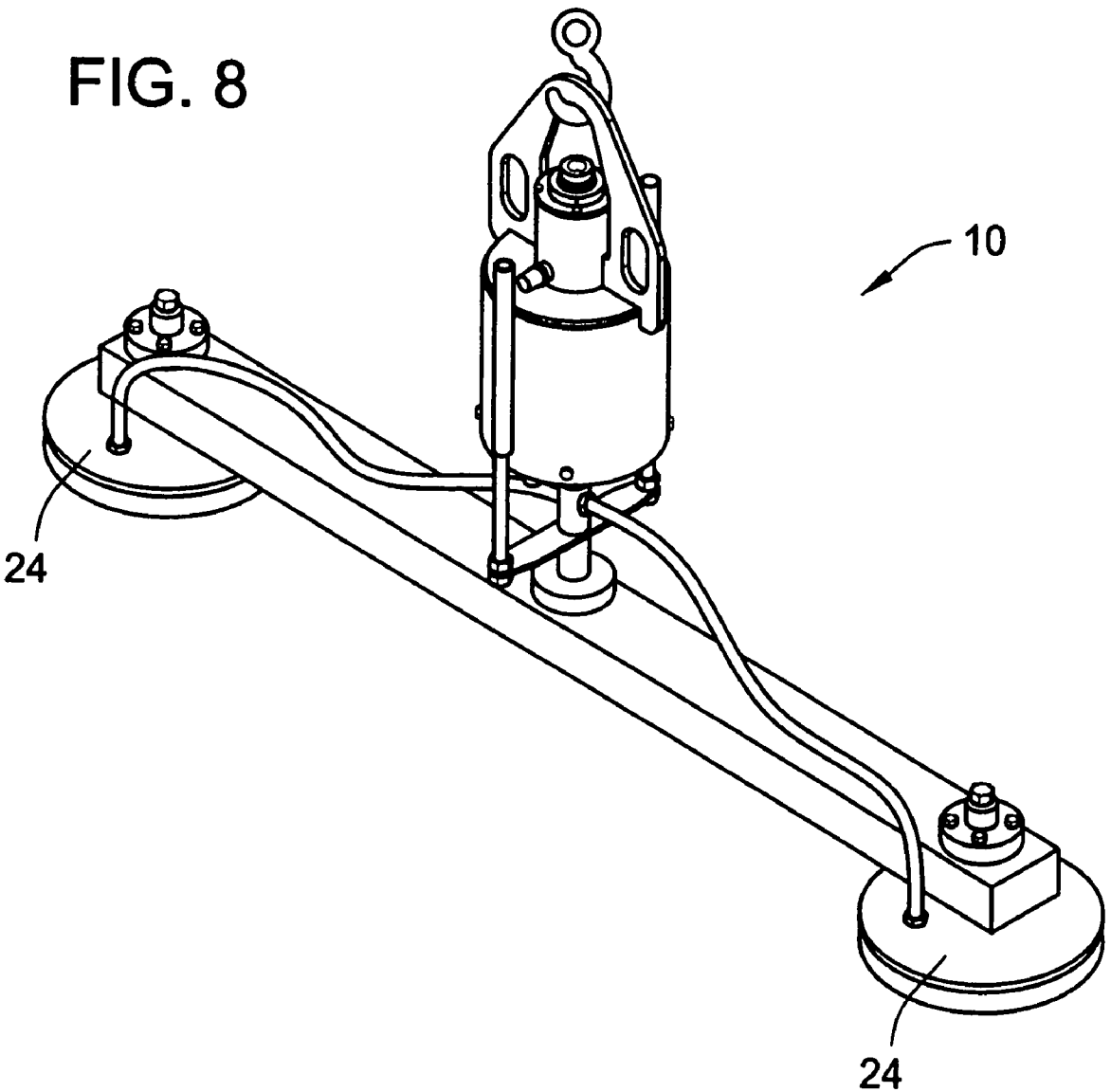
FIG. 8 is a perspective illustration of an alternate exemplary embodiment of the invention having multiple vacuum lifting pads.

As shown in FIG. 8, although the preceding description has presented an exemplary embodiment of the invention having only a single vacuum pad 24, in other embodiments of the invention it may be desirable to practice the invention in forms having multiple vacuum pads.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A vacuum-assisted lifting apparatus, for lifting a load when a lifting force is applied to the lifting apparatus on a load lifting stroke of the lifting force, and for automatically releasing the load at the end of the load lifting stroke when the load is lowered onto a support, to thereby allow the lifting apparatus to be lifted off of the load by application of the lifting force during a successive non-lifting stroke of the lifting force, the apparatus comprising:

a self-contained, load-bearing, lift structure having relatively movable elements thereof operatively connected to one another in a manner selectively generating or not generating a vacuum for respectively gripping or not-gripping the load as the lifting force is applied to the lift structure; and a non-load bearing control valve attached to the lift structure by a non-load bearing valve support housing, and operatively connected to be actuated by movement of at least one of the relatively movable elements of the lift structure on successive applications of the lifting force to the lift structure, in a manner causing the lift structure to generate vacuum on the load lifting stroke and to not generate vacuum on the successive non-lifting stroke.

2. The apparatus of claim 1, wherein, the control valve is a mechanically actuated latching valve.

3. The apparatus of claim 2, wherein, the control valve is removable from the lift structure without disassembly of the lift structure.

4. The apparatus of claim 2, wherein, the mechanically actuated latching valve, comprises:

one or more positioning cams defining HIGH and LOW positions for a cam follower, operatively connected to a movable sealing member for moving the movable seal member in a manner causing the lift structure to generate vacuum on the load lifting stroke and to not generate vacuum on the successive non-lifting stroke, by action of the at least one of the relatively movable elements of the lift structure;

whereby, in the HIGH position, the sealing member is positioned in such a manner that vacuum is not generated, regardless of the relative position of the relatively movable elements of the lift structure; and whereby, in the LOW position, the sealing member is positioned in such a manner that vacuum is generated by relative movement of the relatively movable elements of the lift structure.

5. The apparatus of claim 1, wherein, the control valve is removable from the lift structure without disassembly of the lift structure.

6. The apparatus of claim 5, wherein, the lift structure defines an exterior thereof and the control valve and valve support housing are located external to the lift structure and attached to the exterior of the lift structure.

7. The apparatus of claim 6, wherein the lift structure includes a cylinder housing adapted for receiving the lifting force, and, the cylinder housing defines a valve seat surrounding a port extending through the cylinder housing, and the control valve is a mechanically actuated latching valve, comprising:

one or more positioning cams defining HIGH and LOW positions for a cam follower, operatively connected to a movable sealing member for moving the movable seal member in to and out of contact with the valve seat, by action of the at least one of the relatively movable elements of the lift structure;

whereby, in the HIGH position, the seal member is held away from the valve seat in such a manner that vacuum is not generated, regardless of the relative position of the relatively movable elements of the lift structure; and whereby, in the LOW position, the seal member is released to rest sealingly upon the valve seat in such a manner that vacuum is generated by relative movement of the relatively movable elements of the lift structure.

8. The apparatus of claim 1, wherein;

the lift structure includes a cylinder housing adapted for receiving the lifting force, and at least one movable element that is movable relative to the cylinder housing as lifting force is applied to the cylinder housing to define a variable fluid cavity for selectively generating the vacuum; and the valve support housing is fixedly attached to the cylinder housing, with the control valve including a movable seal member thereof configured for intermittent operative contact with the at least one movable element of the lift structure during each of the successive load-lifting and non-lifting stroke applications of the lifting force to the cylinder housing, with the movable seal member sealing and unsealing the variable fluid cavity on the successive load-lifting and non-load lifting stroke applications of the lifting force to the cylinder housing.

9. The apparatus of claim 8, wherein, the control valve latches the movable seal member in a closed position thereof, during the entirety of the load-lifting stroke and latches the movable seal member in an open position thereof during the entirety of the non-load lifting stroke.

10. The apparatus of claim 8, wherein, the control valve is removable from the lift structure without disassembly of the lift structure.

11. The apparatus of claim 8, wherein, the control valve is mounted to the exterior of the cylinder housing, with the movable seal member of the control valve disposed exterior to the cylinder housing, and at least one of the at least one movable element of the lift structure intermittently extends through the cylinder housing for operatively contacting the movable seal member of the control valve, to thereby alternately cycle the movable seal member between open and closed positions of the movable seal member on successive intermittent operative contact of the movable element of the lift structure with the movable sealing member of the control valve.

12. The apparatus of claim 11, wherein, the control valve latches the movable seal member in the closed position during the entirety of the load-lifting stroke, and latches the movable seal member in the open position during the entirety of the non-load lifting stroke.

13. The apparatus of claim 11, wherein, the cylinder housing defines a valve seat surrounding a port extending through the cylinder housing, and the control valve is a mechanically actuated latching valve, comprising:

one or more positioning cams defining HIGH and LOW positions for a cam follower, operatively connected to the movable sealing member for moving the seal member in to and out of contact with the valve seat, in response to contact of the movable element of the lift structure with the movable sealing member of the control valve;

whereby, in the HIGH position, the seal member is held away from the valve seat in such a manner that vacuum is not generated, regardless of the relative position of the relatively movable elements of the lift structure; and whereby, in the LOW position, the seal member is released to rest sealingly upon the valve seat in such a manner that vacuum is generated by relative movement of the relatively movable elements of the lift structure.

14. The apparatus of claim 11, wherein, the cylinder housing defines a lifting axis and a cylinder bore extending along the lifting axis, and the lift structure further comprises:

a piston having an axial thickness thereof, the piston being sealingly disposed in the cylinder bore and movable axially with respect to the cylinder bore along the lifting axis, with the piston and cylinder bore, in combination, defining the variable fluid cavity;

a suction cup device, adapted for gripping the load, and operatively connected in fluid communication with the fluid cavity; and a piston rod, having first and second axial ends thereof, with the suction cup device being attached to the second end, and the first end sealingly extending through the piston for limited sliding movement through the piston between upper and lower piston rod travel stops axially spaced a rod travel distance apart, and operatively connected to the piston rod, with the rod travel distance being greater than the thickness of the piston, such that the piston rod urges axial movement of the piston in the cylinder bore when the piston is contacting either the upper or the lower rod travel stops while a substantially axially directed force is being applied to the piston rod, and such that the piston rod may slide through the piston and extend through the cylinder housing for operatively contacting and moving the movable seal member of the control valve to the closed position thereof at the beginning of a load-lifting stroke, and successively operatively contacting and moving the movable seal member of the control valve to the open position thereof at the end of the load-lifting stroke.

15. The apparatus of claim 14, wherein, the control valve latches the movable seal member in the closed position thereof during the entirety of the load-lifting stroke, and latches the movable seal member in the open position thereof during the entirety of the non-lifting stroke.

16. The apparatus of claim 14, wherein, the lift structure further comprises a detent mechanism operatively connected between the cylinder housing and the piston rod for precluding extension of the piston rod with respect to the cylinder housing during the non-load lifting stroke.

17. The apparatus of claim 14, wherein, the piston rod includes an internal bore therein operatively providing sealed fluid communication between the fluid cavity and the suction cup device.

18. The apparatus of claim 14, further comprising, a visual indicator of relative position of the piston within the cylinder bore, whereby the presence of vacuum within the fluid cavity is displayed.

19. The apparatus of claim 11, wherein, the cylinder housing defines a valve seat surrounding a port extending through the cylinder housing, and the control valve is a mechanically actuated latching valve, comprising:

one or more positioning cams defining HIGH and LOW positions for a cam follower, operatively connected to the movable sealing member for moving the seal member in to and out of contact with the valve seat, in response to contact of the upper end of the piston rod with the movable sealing member of the control valve;

whereby, in the HIGH position, the seal member is held away from the valve seat in such a manner that vacuum is not generated, regardless of the relative position of the piston within the cylinder bore; and whereby, in the LOW position, the seal member is released to rest sealingly upon the valve seat in such a manner that vacuum is generated by movement of the piston within the cylinder bore.

20. A vacuum-assisted lifting apparatus, for lifting load from a support, the apparatus comprising:

a cylinder housing, adapted for supporting the load, and defining a lifting axis and a cylinder bore extending along the lifting axis;

a piston having an axial thickness thereof, the piston being sealingly disposed in the cylinder bore and movable axially along the lifting axis, with the piston and cylinder bore, in combination, defining a sealed fluid cavity;

a control valve attached to the cylinder housing, by a valve support housing, and having a movable seal member thereof operatively disposed for selectively sealing and unsealing the fluid cavity;

a suction cup device, adapted for gripping the load, and operatively connected in fluid communication with the fluid cavity; and a piston rod, having first and second axial ends thereof, with the suction cup device being attached to the second end, and the first end sealingly extending through the piston for limited sliding movement through the piston between upper and lower piston rod travel stops axially spaced a rod travel distance apart, and operatively connected to the piston rod, with the rod travel distance being greater than the thickness of the piston, such that the piston rod urges axial movement of the piston in the cylinder bore when the piston is contacting either the upper or the lower rod travel stops while a substantially axially directed force is being applied to the piston rod, and such that the piston rod may slide through the piston for operatively contacting and moving the movable seal member of the control valve, in certain predetermined relative orientations of the piston rod, piston and cylinder bore, to thereby seal and unseal the fluid cavity.

21. The apparatus of claim 20, wherein, the control valve and valve support housing are non-load bearing.

22. The apparatus of claim 20, wherein, the control valve alternately seals and unseals the fluid cavity on successive contacts of the piston rod with the movable sealing member of the control valve, such that the fluid cavity can produce a vacuum when the fluid cavity is sealed and the piston moves in a manner enlarging the volume of the fluid cavity.

23. The apparatus of claim 20, wherein, the piston rod defines an axially extending bore therein forming at least part of the operative fluid connection between the fluid cavity and the suction cup device.

24. The apparatus of claim 20, wherein, the juncture between the piston and cylinder bore are sealed with a sliding piston seal element.

25. The apparatus of claim 20, wherein, the juncture between the piston and piston rod are sealed with a sliding rod seal element.

26. A vacuum-assist lifting apparatus, for lifting a load from a support, the apparatus comprising:

a cylinder housing, a piston, a piston rod, a control valve, a fluid communication conduit, and a suction cup device adapted for gripping the load;

the cylinder housing, adapted for supporting the load, defining a vertical lifting axis, upper and lower ends of the cylinder housing, and an axially oriented cylinder bore extending along the lifting axis, with the cylinder housing having upper and lower end-of-stroke stops for limiting travel of the piston within the cylinder bore, the cylinder housing also having an annular wall substantially closed at an upper end thereof by an upper end wall, with the upper end wall having a central opening therein;

the control valve attached to the cylinder housing and having a movable sealing member thereof operatively disposed for selectively opening and closing the central opening in the upper end wall of the cylinder housing;

the piston defining a thickness of the piston, being sealingly disposed within the cylinder bore for movement axially within the cylinder bore, and having a central hole therein for passage therethrough of the piston rod;

the cylinder bore, piston, and sealing member of the control valve defining a fluid cavity within the bore above the piston, the fluid cavity being sealed when the sealing member is closing the central opening, and not-sealed when the sealing member is not closing the central opening;

the fluid communication conduit operatively connecting the fluid cavity to the suction cup device;

the piston rod having an upper and a lower end thereof and being operatively disposed for movement along the vertical lifting axis with respect to the cylinder bore, with the lower end of the piston rod being adapted for attachment thereto of the suction cup device;

the piston rod sealingly extending through the central hole in the piston and being operatively coupled to the piston for limited sliding axial movement through the piston between upper and lower piston rod travel stops axially spaced a rod travel distance apart;

the upper piston rod travel stop being disposed to bear downwardly on the piston, and thereby urge downward movement of the piston with the cylinder bore, when the piston rod is being urged to move downward in the cylinder bore by upward movement of the cylinder housing along the lifting axis while the load is being gripped by the suction cup device or as a result of gravitational force acting on the piton rod and suction cup device;

the lower piston rod travel stop being disposed to bear upwardly against the piston to thereby urge the piston to move upward in the cylinder bore when the piston rod is being urged to move upward in the cylinder bore by virtue of the cylinder housing being lowered along the lifting axis while the suction cup device is resting on the load or the support;

the rod travel distance being greater than the thickness of the piston, so that as the piston rod is urged upward in the bore, the piston rod slides through the piston the rod travel distance and the upper end of the piston rod extends upward beyond the piston for contacting the movable sealing member of the control valve, and moving the sealing member to thereby unseal the central opening in the upper wall of the cylinder housing.

27. The apparatus of claim 26, wherein, the control valve is a mechanically actuated latching valve, comprising:

one or more positioning cams defining HIGH and LOW positions for a cam follower, operatively connected to the movable sealing member for moving the sealing member in to and out of contact with the upper end wall of the cylinder housing for respectively closing and opening the central opening in the end wall of the cylinder housing, in response to contact of the upper end of the piston rod with the movable sealing member of the control valve;

whereby, in the HIGH position, the sealing member is held away from the upper wall of the cylinder housing in such a manner that the fluid cavity is unsealed and vacuum is not generated in the fluid cavity, regardless of the relative position of the piston within the cylinder bore; and whereby, in the LOW position, the seal member is released to rest sealingly against the upper wall of cylinder housing in such a manner that the fluid cavity is sealed and vacuum is generated in the fluid cavity by movement of the piston within the cylinder bore.

* * * * *